US005904755A

United States Patent [19]

Kanazashi et al.

[11] Patent Number: 5,904,755

[45] Date of Patent: May 18, 1999

[54] FURNITURE HAVING AIR CONTROL FUNCTIONS

[75] Inventors: Tadashi Kanazashi; Kazumasa Yonedo, both of Tibaken, Japan

[73] Assignee: Tornex, Inc., Tibaken, Japan

[21] Appl. No.: 08/713,786

[22] Filed: Sep. 13, 1996

[51] Int. Cl.[6] ..... B03C 3/011

[52] U.S. Cl. ..... 96/55; 55/337; 55/385.1; 55/459.1; 96/61

[58] Field of Search ..... 55/337, 385.8, 55/385.1, 459.1, 460; 131/202, 209, 336, 339, 341, 238; 454/284; 96/55, 57, 61, 58

[56] References Cited

U.S. PATENT DOCUMENTS

| | | | |
|---|---|---|---|
| 3,516,232 | 6/1970 | Gilbertson | 55/385.1 X |
| 3,797,205 | 3/1974 | Weisskopf | 131/238 X |
| 3,890,126 | 6/1975 | Joseph | 55/385.1 |
| 4,397,226 | 8/1983 | Lind | 55/337 X |
| 4,623,367 | 11/1986 | Paulson | 55/385.8 |
| 5,088,508 | 2/1992 | Duncan | 55/385.8 X |
| 5,160,517 | 11/1992 | Hicks et al. | 55/385.1 |
| 5,230,720 | 7/1993 | Kendall | 55/385.1 X |
| 5,591,242 | 1/1997 | Kuo | 55/385.8 X |

*Primary Examiner*—Richard L. Chiesa
*Attorney, Agent, or Firm*—Bauer & Schaffer, LLP

[57] ABSTRACT

A body furniture is provided having one or more air exhaust ports and a built-in air fan. A top plate having one or more air suction port is positioned on the furniture body, and a tornado-based suction unit is removably placed on the one or more of the air suction ports. The tornado-based suction unit includes a cylinder having a window formed through a peripheral wall thereof, and a suction hole formed through at least one of end surfaces of the cylinder connected to a suction side of the air fan. An artificial tornado is generated within the cylinder and collects contaminated air such as the smoke of cigarettes. The collected contaminated air is cleaned. Minus ions or fragrance may be supplied to air sucked from the suction hole to fill a space around the body.

5 Claims, 16 Drawing Sheets

FURNITURE HAVING AIR CONTROL FUNCTIONS

BACKGROUND OF THE INVENTION

1. Field of the Invention

The present invention relates generally to a furniture having air control functions, and more particularly to a furniture having air control functions which sucks contaminated air due to smoke, dust particles, bad smell, hazardous gas, and so on possibly existing near the furniture, with artificially generated tornados, to clean air around the furniture.

2. Description of the Related Art

A conventional furniture a having air control functions is illustrated in FIGS. 1 and 2. The furniture a comprises an air exhaust port c through one side wall of a table body b; an air suction port e through a top plate d of the table body b; a shield plate f supported by stems g above the air suction port e and having an area smaller than the area of the top plate d; and an air fan h and an air cleaner j located between the air suction port e and the air exhaust port c in the table body b.

With the furniture a having air control functions thus constructed, when a man smokes a cigarette near the furniture a, smoke of the cigarette passes into a space between the top plate d and the shield plate f together with surrounding air, enters the table body b through the air suction port e, cleaned by the air cleaner j, and exhausted to the outside through the air exhaust port c formed through the one side wall of the table body b.

There is also known another furniture $a_1$ having air conditioning functions, as illustrated in FIG. 3, which comprises an edge plate k which rises along the periphery of an air suction port e formed through the top plate d, and an edge plate m obliquely downwardly protruding from the periphery of the shield plate f in order to efficiently collect contaminated air such as smoke of cigarette floating near the periphery of the top plate d.

However, since the first furniture a having air control functions merely sucks contaminated air such as smoke of cigarette through the air suction port e below the top plate d, it cannot be said that this furniture is sufficiently effective in view of a broad meaning of collection. The second furniture $a_1$, on the other hand, is advantageous over the first furniture a in collecting contaminated air such as smoke of cigarette and so on from a wider range therearound by virtue of he edge plate m obliquely downwardly protruding from the periphery of the shield plate f. However, since the second furniture $a_1$ cannot sufficiently collect contaminated air above the top plate f, it does not produce effects corresponding to an increase in cost for designing and manufacturing this type of furniture.

In addition, the prior art examples illustrated in FIGS. 1, 2 and 3 have nothing to cover the air suction port e between the top plate d and the shield plate f, so that if ash of cigarette or the like scatters around the furniture, the ash enters the table body b through the air suction port e. While relatively large particles are collected by a prefilter n of the air cleaner j, smaller particles passing through the prefilter n enter an electric dust precipitator, if present, to cause short-circuiting between electrodes of the electric dust precipitator. Crisp noise caused by the short-circuiting would annoy persons around the furniture.

OBJECTS AND SUMMARY OF THE INVENTION

In view of the problems mentioned above, it is an object of the present invention to provide a furniture having air control functions which is capable of ensuring a wider collecting range by means of tornados having eddy convergence to collect as much contaminated air as possible for cleaning the collected contaminated air.

It is another object of the present invention to provide a furniture having air control functions which is capable of preventing foreign particles from entering the furniture to avoid the generation of continuous crisp noise due to the short-circuiting between electrodes of a built-in electric dust precipitator.

To achieve the above objects, the present invention provides a furniture having an air control functions comprising a furniture body having at least one air exhaust port; an air fan arranged in the furniture body; and tornado generating means.

The above and other objects, features, and advantages of the present invention will become apparent from the following description of the preferred embodiment taken in conjunction with the accompanying drawings.

DESCRIPTION OF THE PREFERRED EMBODIMENTS

Figure 1:
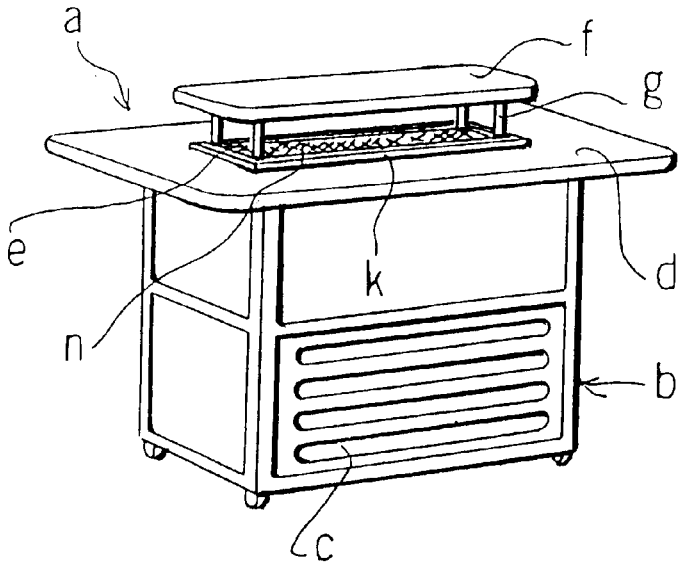
Fig1 Prior Art
FIG. 1 is a perspective view illustrating a prior art example.
Figure 2:
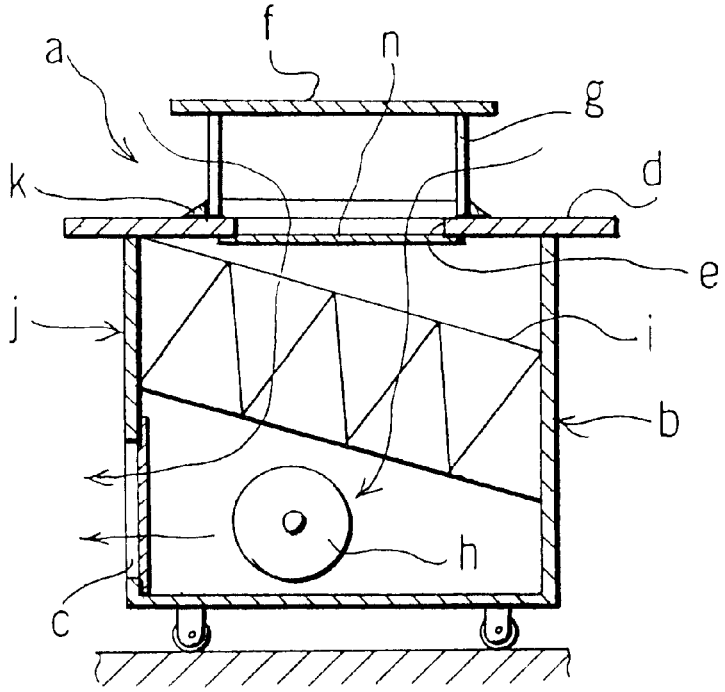
Fig2 Prior Art
FIG. 2 is a cross-sectional view illustrating the internal structure of the prior art example shown in FIG. 1.
Figure 3:
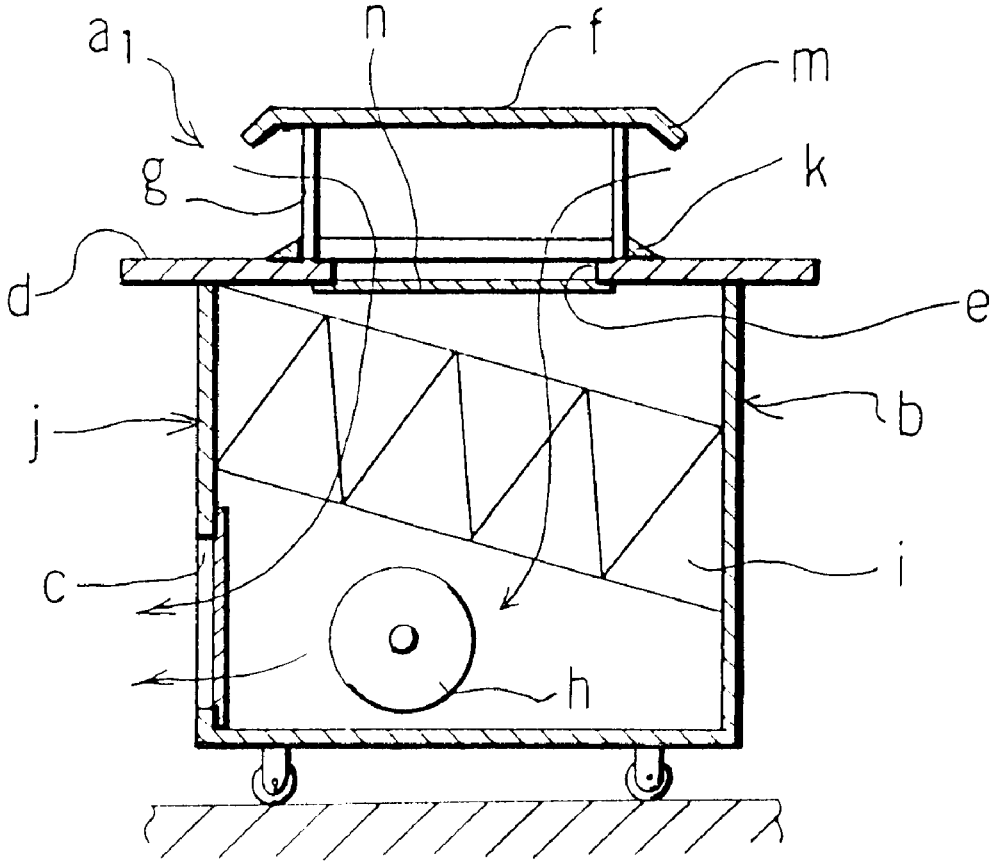
Fig3 Prior Art
FIG. 3 is a cross-sectional view illustrating another prior art example.

The present invention will hereinafter be described in connection with the preferred embodiments thereof.

A furniture 1 having air control functions, as illustrated in FIGS. 4–7, comprises a furniture body having one or more air exhaust port 2 and a built-in air fan 3 and a tornado generator unit 5 located, for example, on a table body 4.

Figure 4:
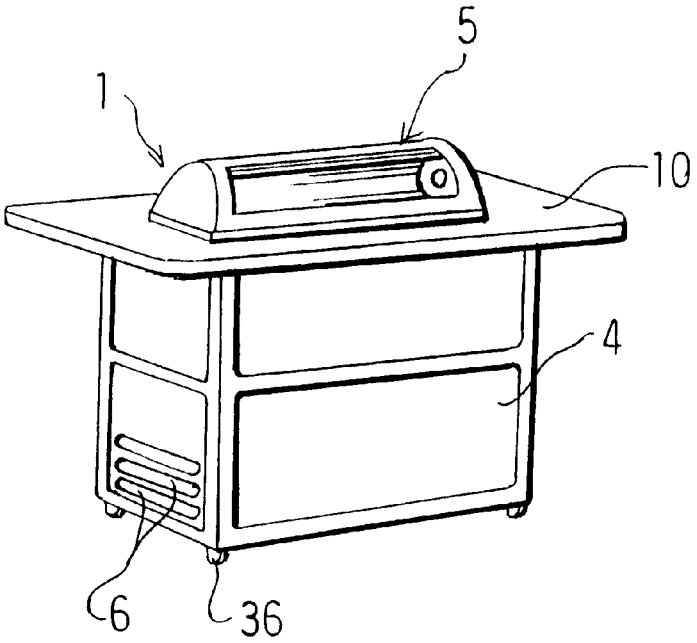
FIG. 4 is a perspective view illustrating a furniture having air control functions according to an embodiment of the present invention.
Figure 5:
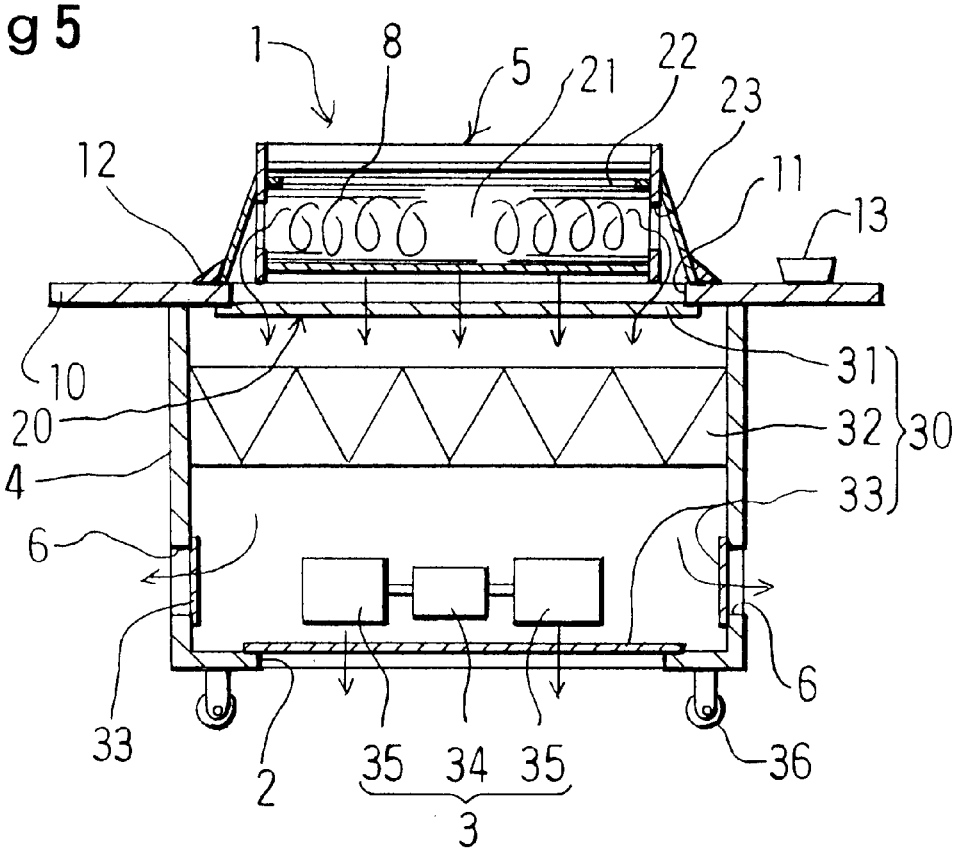
FIG. 5 is a cross-sectional view illustrating the internal structure of the furniture having air control functions shown in FIG. 4.

The table body 4 comprises a box open to the upward direction; an air exhaust port 2 formed through the bottom of the box; air by-pass ports 6 through both side walls of the box; and casters 36 for easy movements. The furniture 1 having air control functions may be equipped with the tornado generator unit 5 removably placed directly on a top plate 10, as illustrated in FIG. 4. Specifically, the top plate 10 is placed on the table body 4, and an air suction port 11 having a predetermined opening dimension is formed through the top plate 10. The air suction port 11 is located on the suction side of an air fan 3, and an edge plate 12 is placed around the air suction port 11. The tornado generator unit 5 is removably fitted inside the edge plate 12 to overlay the air suction port 11.

While the top plate 10 is generally made of a flat plate having a predetermined thickness, it may have another shape without limited to any particular shape. The material of the top plate 10 is not either limited, and wood, plastic, metal, and so on may be employed. Also, while a separate movable ashtray 13 may be placed on the top plate 10, the ashtray 13 may be fixed at a predetermined position on the top plate 10.

Figure 6:
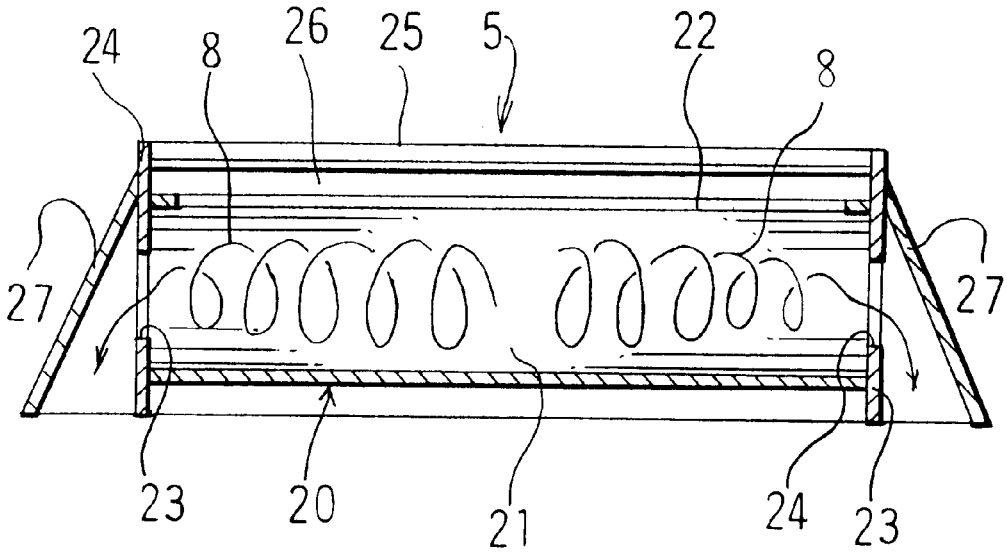
FIG. 6 is an enlarged cross-sectional view illustrating a tornado generator in FIG. 5.
Figure 7:
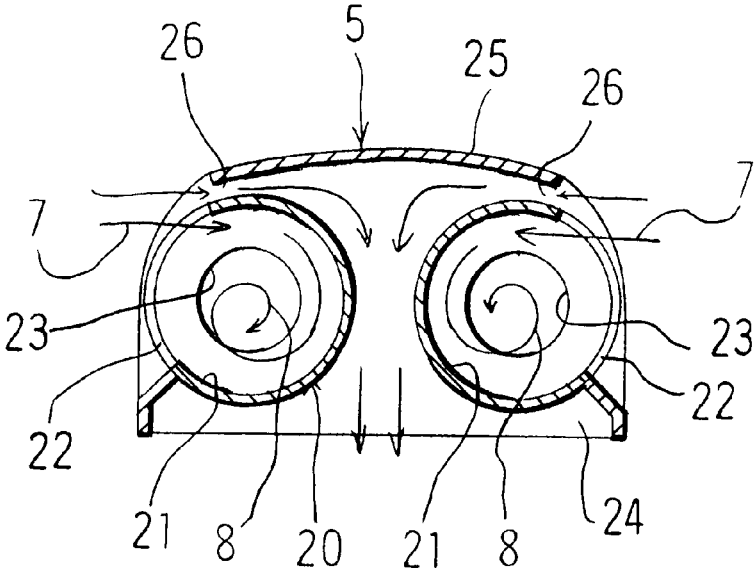
FIGS. 7 and 8 are cross-sectional views illustrating the tornado generator.

The tornado generator unit 5, as illustrated in FIG. 6, comprises a cylinder 20 having a window 22 formed through the peripheral wall, and a suction hole 23 formed through at least one of side plates 24. The suction hole 23 is connected to the suction side of the air fan 3 to guide an air flow into the cylinder 20 to cause a revolving air flow 7 inside the cylinder 20 and hence generate artificial tornados 8. In this embodiment, the suction hole 23 is formed through each of the side plates 24 of the cylinder 20, and a pair of such cylinders are provided. These cylinders 20 are mounted with their windows 22 not facing each other and with the peripheral walls slightly spaced from each other, and fixed to the side plates 24. Further, a cover 5 is placed overlying the cylinders 20 with a gap between the cylinders and the cover 25 functioning as a suction opening 26 which is connected to the suction side of the air fan 3 through the air suction port 11. Covers 27 are fixed to the side plates 24 for covering the two suction holes 23 formed through the side plates 24, such that the two suction holes 23 are connected to the suction side of the air fan 3 through the air suction port 11 by means of the covers 27.

Figure 8:
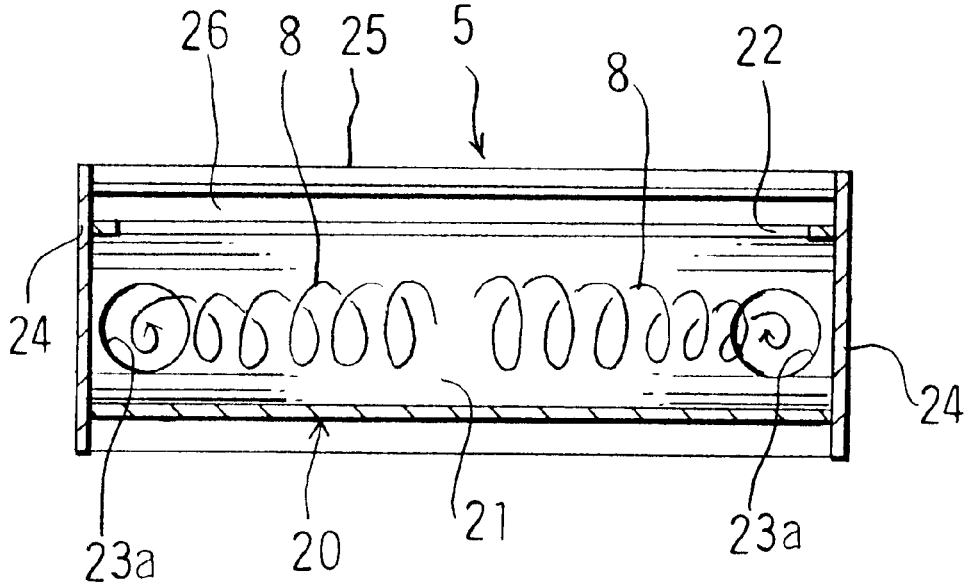
Figure 9:
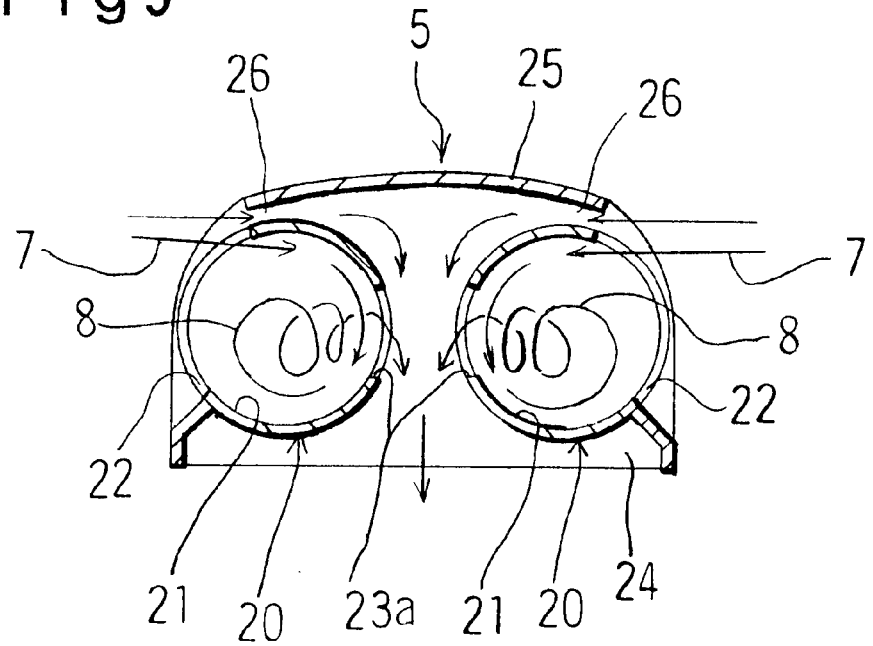
FIGS. 9–17 are cross-sectional views illustrating other embodiments of the present invention.

Alternatively, the tornado generator unit 5 may be structured such that a suction hole 23*a* is formed through a peripheral wall 21 of the cylinder 20 near the side plate 24, the cover 27 is removed, and the suction hole 23*a* is directly connected to the suction side of the air fan 3 through the air suction port 11, as illustrated in FIGS. 8 and 9.

Figure 10:
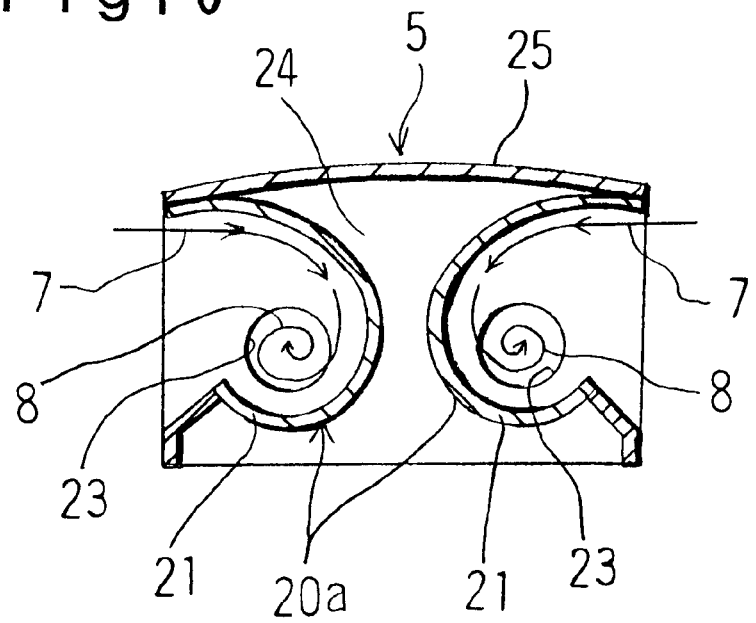
Figure 11:
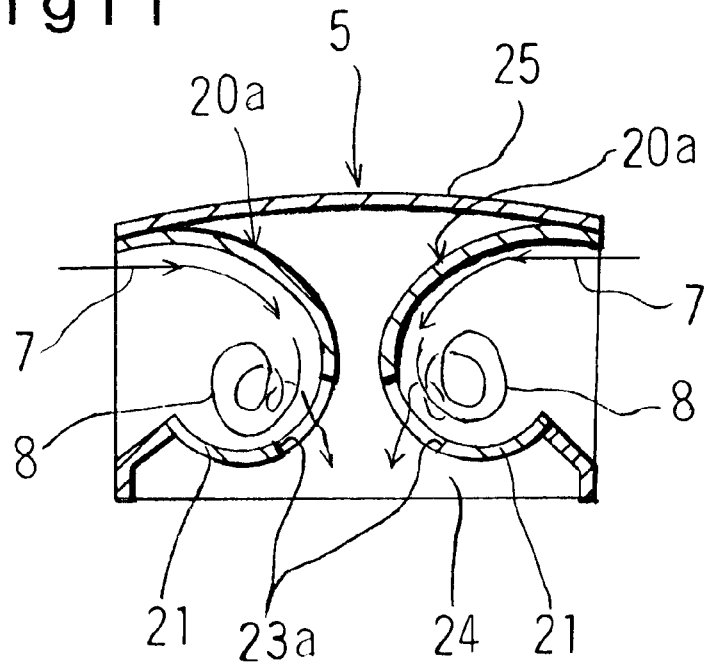

While the cylinder 20 is circular in cross-section, it may be replaced with a spiral cylinder 20*a* as illustrated in FIGS. 10 and 11. The spiral cylinder 20*a* can generate stable tornados 8 without the necessity of the suction opening 26. FIG. 10 illustrates that the suction hole 23 is formed through the side plate 24, and FIG. 11 illustrates that the suction hole 23*a* is formed through the peripheral wall 21. The cylinder 20 is additionally provided with a visualizing means which makes tornados 8 generated in the cylinder 20 visible. Specifically, the inner surface of the cylinder 20 is painted in black to facilitate the viewing of the tornados 8. Thus, the tornado generator unit 5 motivates smokers to blow off smoke toward the cylinders 20, thus effectively preventing smoke from diffusing. Further, if there are two or more air suction ports 11, the same number of tornado generator units 5 are provided.

An air cleaner 30 is provided in the table 4 between the air exhaust port 2 and the tornado generator unit 5. Although not particularly limited, the air cleaner 30 of this embodiment includes a prefilter 31 for filtering out relatively large particles in contaminated air, an electrical precipitator 32 for removing fine particles, and deodorizing filters 33 for removing odor components in the air. The prefilter 31, the electric dust precipitator 32 and the deodorizing filters 33 are positioned in this order in the direction of the air flow in the table body 4. With this construction, the air cleaner 30 has a higher cleaning capability and a longer life than an air cleaner of a type which only passes contaminated air through a single air cleaning filter for removing all contamination components at one time.

The electric dust precipitator 32 has a built-in program which turns off the power supply to the electric dust precipitator 32 for a predetermined time period, for example, ten seconds or reduces a discharge voltage for ten seconds when its electrodes are short-circuited and generates an alarm when the short-circuiting occurs a predetermined number of times within a predetermined time period, for example, ten times within one hour. Essentially, since the suction holes 23 are at relatively high positions and the suction opening 26 is also in an upper portion, ash of cigarette and so on are not so likely to enter the table body 4 through the air suction port 11. However, even if foreign particles having relatively large diameters such as ash enter into the electric dust precipitator 32 to cause short-circuiting between the electrodes, the power supply is turned off or the discharge voltage id reduced, for example, for ten seconds. Therefore, crisp noise caused by the short-circuiting is soon stopped or reduced to a level not audible to human, and the relatively large foreign particles are passed through the electrodes in the meantime, so that crisp noise will not be again generated when the power supply is turned on after the predetermined time period. Further, since the occurrence of continuous short-circuiting between the electrodes causes the alarm to be generated, appropriate measures can be taken in response to the alarm.

The deodorizing filters 33 cover entire areas of the air exhaust port 2 formed through the bottom of the table body 4 and the air by-pass ports 6 formed through the side walls of the table body 4 for removing odor in air from which floating substances have been removed by the electric dust precipitator 32 to provide clean air.

The air fan 3 is constructed by a motor 34 and impellers 35 attached on left and right shafts of the motor 34 for sucking contaminated air existing above the top plate 10, particularly around the periphery of the top plate 10 together with ambient air from the air suction port 11 into the table body 4, passes the contaminated air through the air cleaner 30, and exhausts cleaned air from the air exhaust port 2 formed through the bottom of the table body 4. Therefore, the air fan 3 may be of any shape, structure, and so on as long as it provides a predetermined pressure and a predetermined wind amount.

Next, how to use the furniture 1 having air control functions constructed as described above will be described.

First, the furniture having air control functions is installed at a required place. Specifically, the table body 4 is first located, the top plate 10 is secured on the table body 4, and the tornado generator unit 5 is mounted on the top plate 10. Then, the air fan 3 is powered on. The air fan 3, when in a steady operating state, sucks air around the tornado generator unit 5 from the suction holes 23 and the suction opening 26. The air which has entered through the suction opening 26 reaches the cylinders 20 through windows 22 and guided by an arcuate peripheral wall 21 to generate a revolving air flow 7. Within this revolving air flow 7, a negative pressure region is formed by the air sucked from the suction holes 23 to produce a centripetal force. Simultaneously, a centrifugal force is also produced by the revolving air flow 7, so that the revolving air flow 7 produces a vortex flow within a range in which the centripetal force balances with the centrifugal force, thus generating in each of the cylinders 20 the tornados 8 converging to the central axis of the revolving air flow 7 while forwarding to the suction holes 23.

When a man smokes cigarette near the furniture 1 having air control functions in the state described above, the smoke together with surrounding air is immediately sucked through the suction holes 23, the covers 25 and the air suction port 11 into the table body 4 by the eddy convergence of the tornados 8 generated by the tornado generator unit 5. Simultaneously, the smoke above the upper suction opening 26 of the tornado generator unit 5 is also sucked through paths formed by the covers 27 and the air suction port 11 into the table body 4. The air including smoke is passed through the prefilter 31 to remove relatively large particles included in the sucked air, passed through the electric dust precipitator 32 to collect fine particles, and passed through the deodorizing filter 33 to remove odor components in the air, thus making the contaminated air clean. In this event, the cleaned air is exhausted mainly from the exhaust port 2 toward the floor and partially from the two air by-pass ports 6, such that the amount of the clean air exhausted from the exhaust port 2 is reduced to protect the users from feeling a chill at their feet. In addition, operation noise produced by the air fan 3 is dispersed and reduced.

In this event, if relatively large foreign substances such as cigarette ash enter the electric dust precipitator 32 to cause short-circuiting between the electrodes, the electric dust precipitator 32 is immediately turned off or a discharge voltage is reduced so that crisp noise is immediately stopped or reduced. Then, the electric dust precipitator 32 is again turned on or the discharge voltage is increased to a normal value, after a predetermined time period, to resume the collection of fine particles. If short-circuiting occurs many times, an alarm is generated, so that appropriate measures may be taken in response to the alarm.

Figure 12:
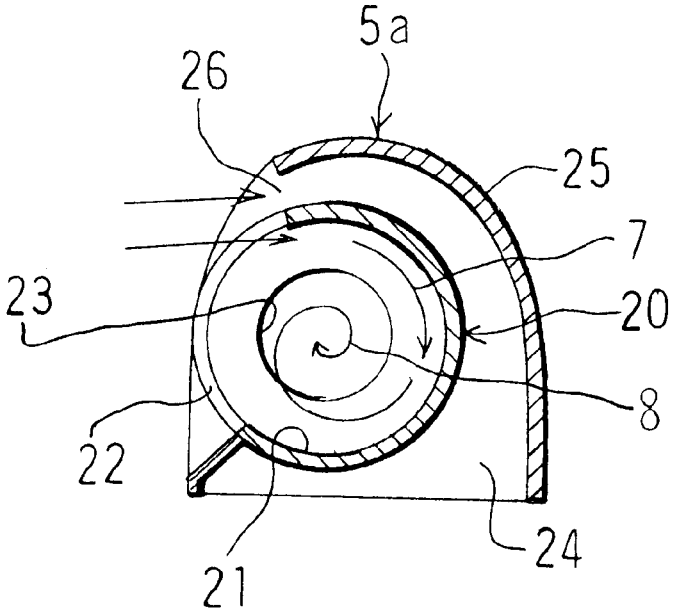

FIG. 12 illustrates a tornado generator unit 5*a* according to another embodiment of the present invention. The tornado generator unit 5*a* differs from the embodiment illustrated in FIGS. 4–7 in that it has only one cylinder 20 for facilitating the use of the furniture 1 having air control functions when installed close to a wall. The remaining structure and operations of this embodiment are similar to those of the embodiment illustrated in FIGS. 4–7, so that corresponding elements are designated the same reference numerals in FIG. 12, and explanation thereon is omitted.

Figure 13:
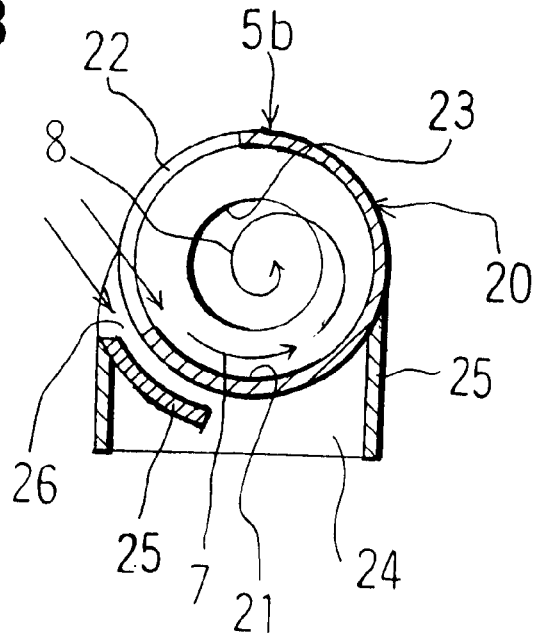

FIG. 13 illustrates a tornado generator unit 5*b* according to a further embodiment of the present invention. The tornado generator unit 5*b* differs from the embodiment illustrated in FIGS. 4–7 in that the suction opening 26 near the cylinder 20 is below the window 22 to generate tornados in the reverse direction. The remaining structure and operations of this embodiment are similar to those of the embodiment illustrated in FIGS. 4–7, so that corresponding elements are designated the same reference numerals in FIG. 13, and explanation thereon is omitted. It will be understood that while FIG. 13 only illustrates one cylinder 20, two cylinders may be provided in the tornado generator unit 5*b*.

Figure 14:
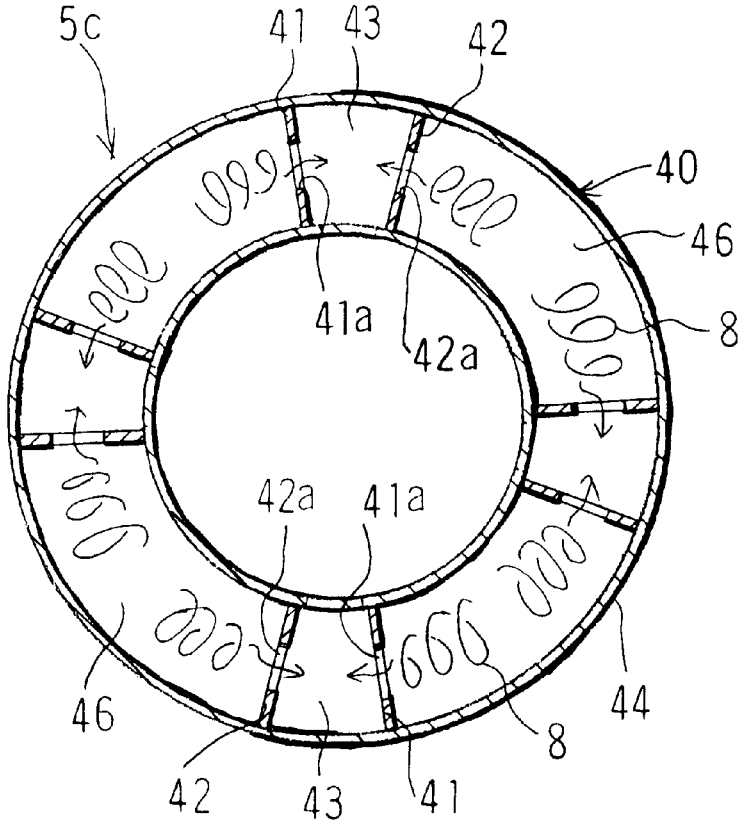
Figure 15:
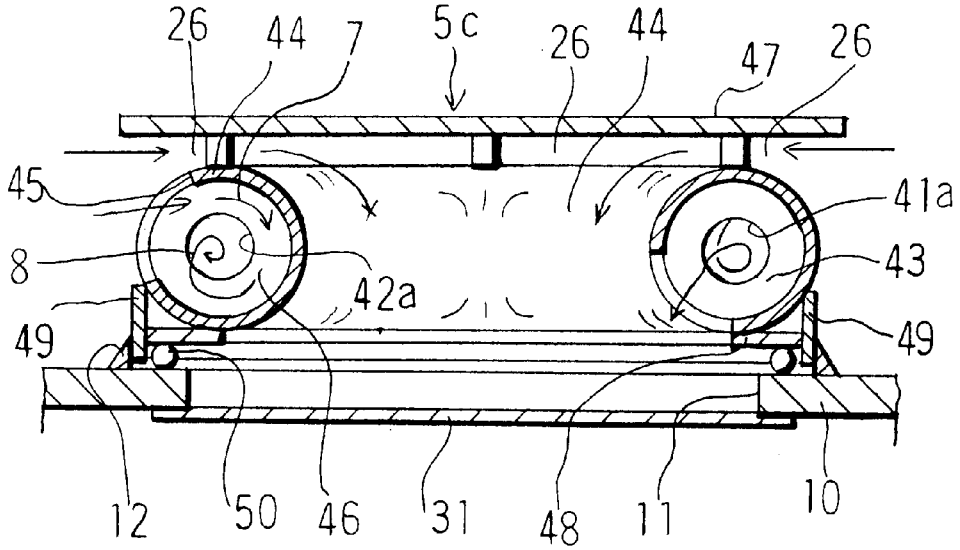

FIGS. 14 and 15 illustrate a tornado generator unit 5*c* according to a further embodiment of the present invention. The tornado generator unit 5*c* differs from the embodiment illustrated in FIGS. 4–7 in that a cylinder 40 has a toroidal form, and the toroidal cylinder 40 is partitioned by pairs of adjacent partitions 41, 42 at equal intervals. The space defined by the two partitions 41, 42 serves as a suction chamber 43, an outer peripheral wall 44 of the toroidal cylinder 40 is formed with a window 45 outside of the suction chamber 43 to form a tornado generating chamber 46. The partitions 41, 42 are formed with suction holes 41*a*, 42*a*, and the suction chamber 43 is connected to the suction side of the air fan 3. Further, an upper top plate 47 is arranged above the toroidal cylinders 40 to form suction openings 26 between the upper top plate 47 and the respective toroidal cylinders 40. Thus, according to the tornado generator unit 5*c*, air sucked from the suction chamber 43 causes arcuate tornados 8 to be generated in the tornado generating chamber 46. The tornados 8 enclose the periphery of the table body 4 to prevent contaminated air such as smoke of cigarette from leaking, thus completely collecting such contaminated air. The remaining structure and operations of this embodiment are similar to those of the embodiment illustrated in FIGS. 4–7, so that corresponding elements are designated the same reference numerals in FIGS. 14 and 15, and explanation thereon is omitted.

The tornado generator unit 5*c* is further provided with a support plate 48 arranged below the toroidal cylinder 40 and with a skirt 49 surrounding the entire periphery of the support plate 48. Then, rotatable wheels 50 are mounted to the support plate 48, and the tornado generator unit 5*c* is rotatably and removably placed on the top plate 10 inside the edge plate 12 around the air suction port 11. As a result, the furniture 1 having air control functions is particularly suitable for use in Chinese restaurants and so on as a table.

Figure 16:
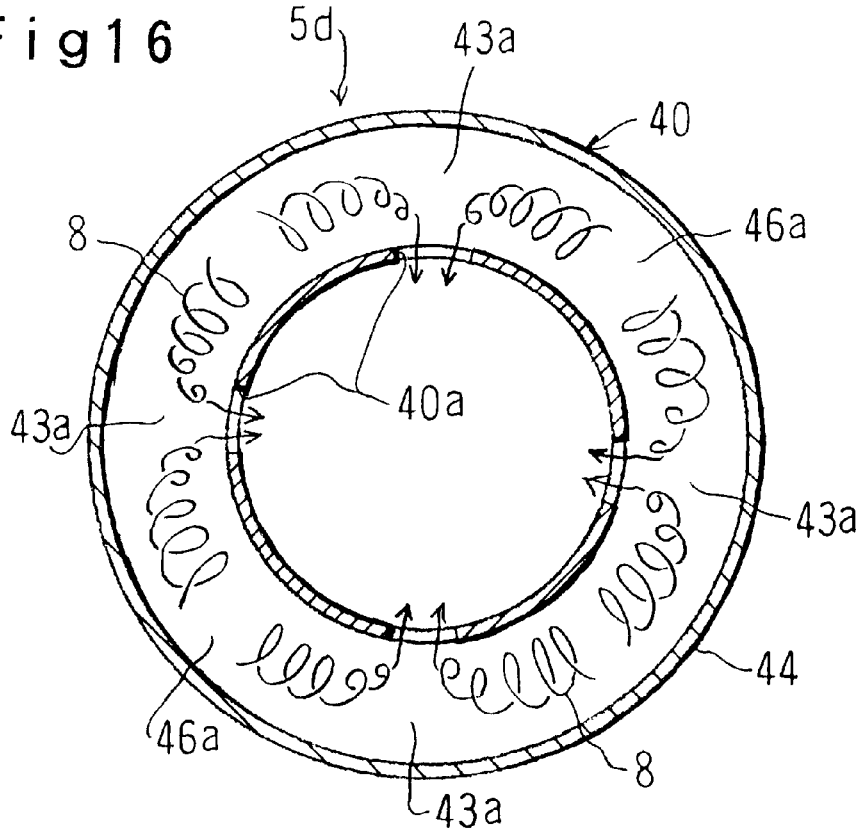
Figure 17:
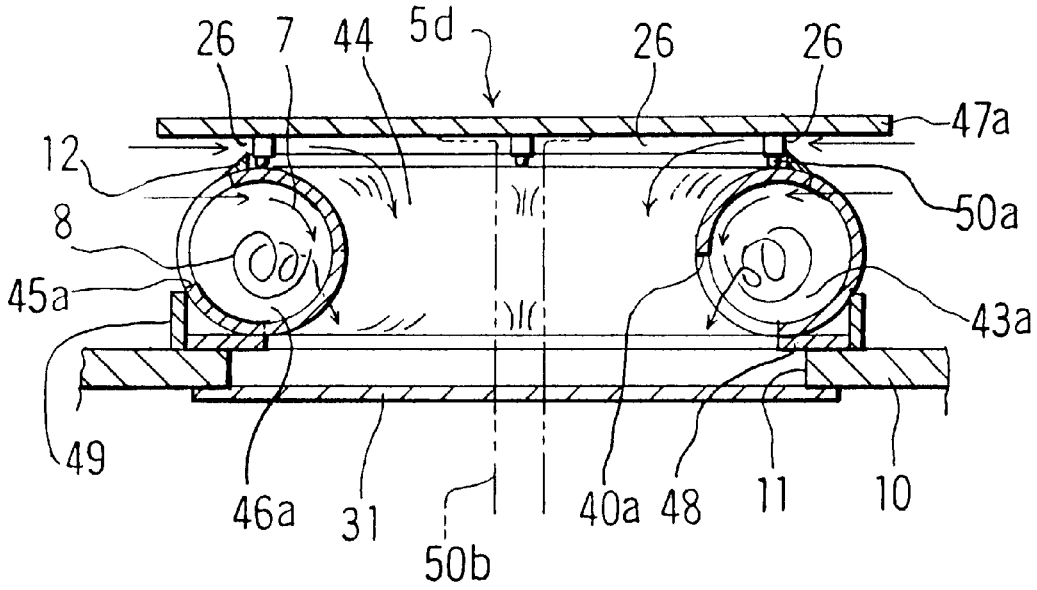

FIGS. 16 and 17 illustrates a tornado generator unit 5*d* according to another embodiment of the present invention. The tornado generator unit 5*d* differs from the tornado generator unit 5*c* in the following structures. First, the toroidal cylinder 40 is formed with a notch 45*a* all around the peripheral wall 44 thereof, and suction holes 40*a* are formed substantially at equal intervals in place of the partitions 41, 42. An area inside the toroidal cylinder 40 near the suction holes 40*a* is defined as a suction zone 43*a*, while an area inside the toroidal cylinder 40 opposite to the suction zone 43*a* is defined as a tornado generating zone 46*a*. The suction holes 40*a* are connected directly to the suction side of the air fan 3, and an upper top plate 47*a* is rotatably and removably mounted on the toroidal cylinder 40 through wheels 50*a*. Therefore, the partitions 41, 42 formed with the suction holes 41*a*, 42*a* are not necessary. The tornado generator unit 5*d* also generates arcuate tornados 8 within the tornado generating zone 46*a* when air is sucked from the suction hole 40*a*. The remaining structure and operations of this embodiment are similar to those of the embodiment illustrated in FIGS. 14 and 15, so that corresponding elements are designated the same reference numerals in FIGS. 16 and 17, and explanation thereon is omitted. In place of the wheels 50*a*, the upper top plate 47*a* may be rotatably supported on the table body 4 for pivotal movements about a shaft 50*b*, as indicated by a two-dot chain line in FIG. 17. It will be understood that the toroidal cylinder 40 may be in a spiral form as illustrated in FIG. 10.

Figure 18:
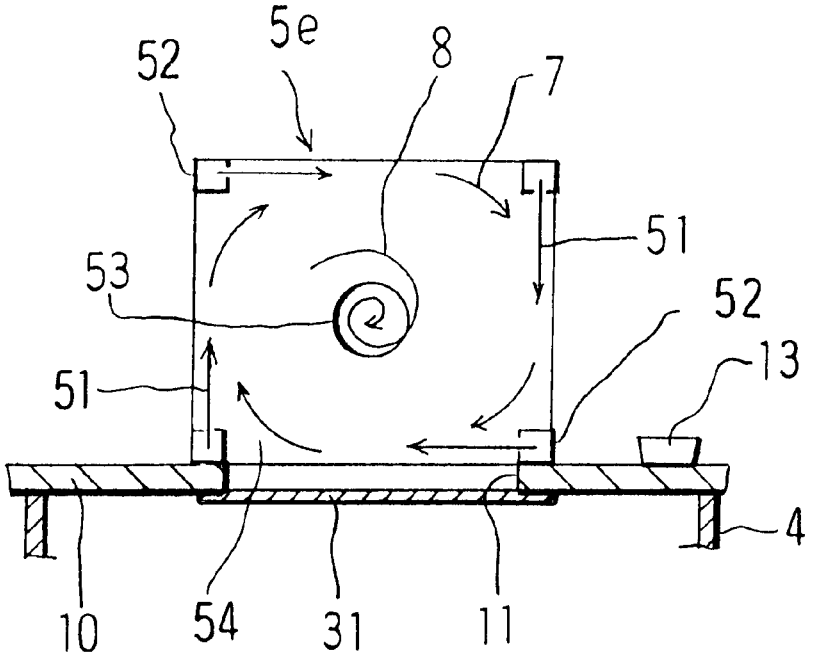
FIGS. 18 and 19 are partially cross-sectional lateral view illustrating other embodiments of the present invention.
Figure 19:
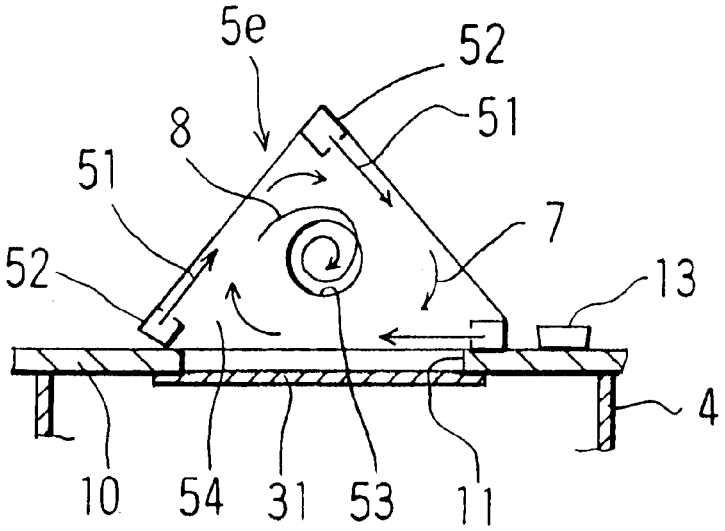

FIGS. 18 and 19 illustrate tornado generator units according to further embodiments of the present invention. A tornado generator unit 5*e* has a predetermined number of air blow-out pipes 52 (four in FIG. 18 and three in FIG. 19) adapted to blow out air to form air curtains 51. The air blow-out pipes 52 are positioned in parallel with each other such that air blown out from the respective pipes 52 rotates in the same direction. The air curtains 51 from the air blow-out pipes 52 cause a revolving air flow 7. Also, a suction hole 53 is formed on at least one of two longitudinal ends of each air blow-out pipe 52 within the range of the revolving air flow 7, and a shield plate 54 is attached to at least the other one of the two end faces.

Then, by blowing out air from the air blow-out pipes 52 and sucking air from the suction hole 53, artificial tornados 8 toward the suction hole 53 are generated in the air forming the air curtains 51. Thus, by incorporating the tornado generator unit 5*e* illustrated in FIG. 18 or 19 in a furniture, for example, the table body 4, the furniture having air control functions can be provided.

Figure 20:
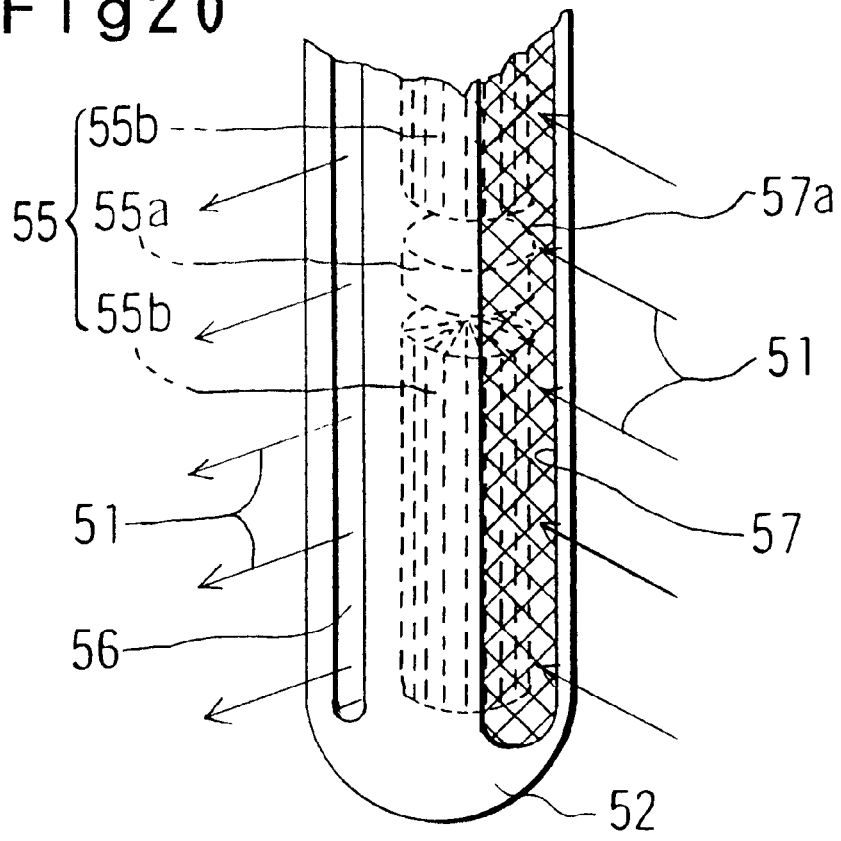
FIG. 20 is a perpspective view illustrating other embodiment of the present invention.

FIG. 20 illustrates an air blow-out pipe 52 of the tornado generator unit 5*e* which has a built-in circulation-type air fan 55 and an air suction port 57, on the opposite side of the air blow-out hole 56, covered with a net 57*a* for preventing foreign substances from introducing thereinto. As a result, an air curtain 41 blown out from the air blow-out hole 56 mostly enters the air suction port 57 as it is and reused, whereby an amount of air sucked from the suction hole 53 can be correspondingly reduced. The air fan 55 has impellers 55*b* on both sides of a motor 55*a*. The impellers 55*b* are rotated by the motor 55*a* to suck external air into the air suction port 57 and to blow out air from the air blow-out hole 56, thus forming the air curtain 51.

Figure 21:
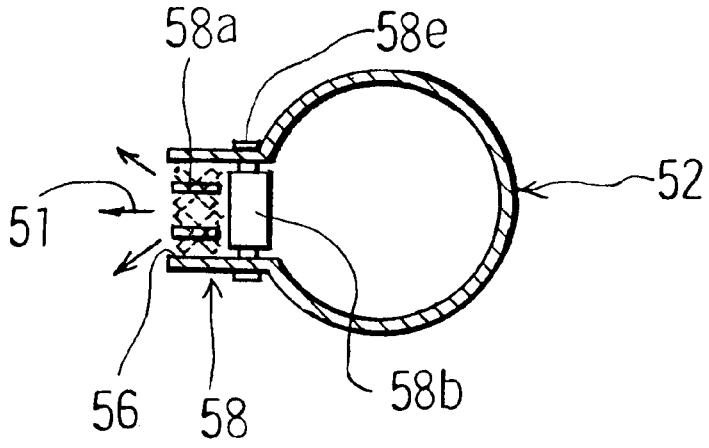
FIGS. 21–30 are cross-sectional views illustrating other embodiments of the present invention.
Figure 22:
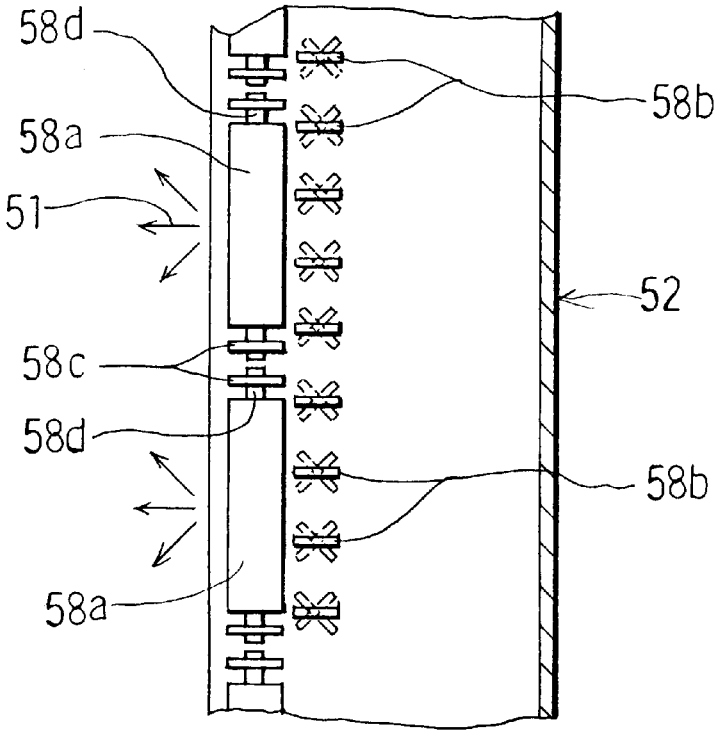

FIGS. 21 and 22 illustrate an air blow-out pipe 52 of the tornado generator unit 5*e* which has a built-in air blow-out direction adjusting unit 58 for changing the air blow-out direction from the air blow-out hole 56 in the vertical and lateral directions. The air blow-out direction can be freely changed to generate artificial tornados depending on changes in situation. The air blow-out direction adjusting unit 58 has horizontal angle adjusting plates 58*a* and vertical angle adjusting plates 58*b*.

The horizontal angle adjusting plates 58*a* are arranged in two columns in parallel with the longitudinal direction of the air blow-out pipe 52 and supported by attachments 58*c* secured on the side wall defining the air blow-out hole 56 for rotation about a shaft 58*d*. Each of the horizontal angle adjusting plates 58*a* can freely change the horizontal angle and can be fixed at a certain angle, as indicated by solid lines and two-dot chain lines in FIG. 21, thus making it possible to freely change the horizontal angle of the air blow-out direction from the air blow-out hole 56.

The vertical angle adjusting plates 58*b* are attached on the side wall defining the air blow-out hole 56 for rotation about associated shafts 58*e*. Each of the vertical angle adjusting plates 58*b* can freely change the vertical angle and can be fixed at a certain angle, as indicated by solid lines and two-dot chain lines in FIG. 22, thus making it possible to freely change the vertical angle of the air blow-out direction from the air blow-out hole 56.

Figure 23:
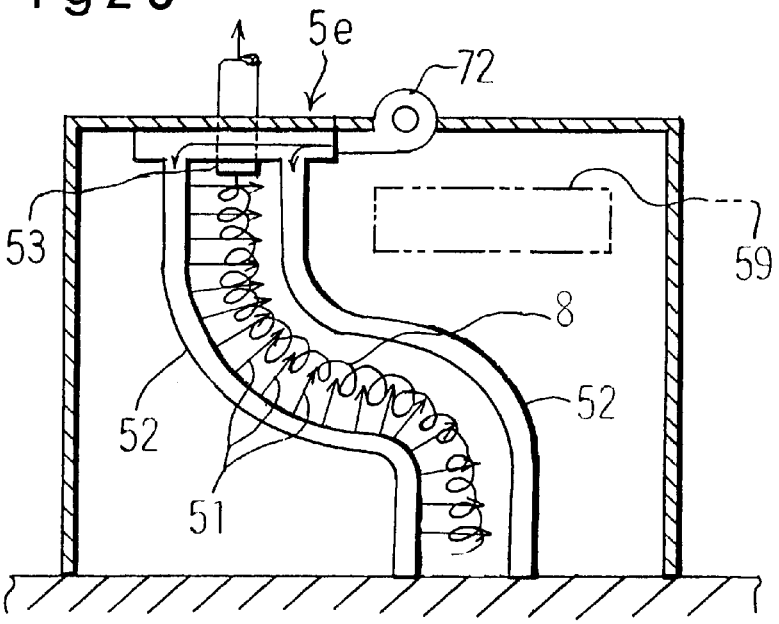

FIG. 23 illustrates a flexible air blow-out pipe 52 of the tornado generator unit 5*e*. The use of the flexible air blow-out pipe 52 enables the tornado generator unit 5*e* to be installed without suffering from any obstacle 59, thus making it possible to suck contaminated substances together with air from the suction hole 53.

Figure 24:
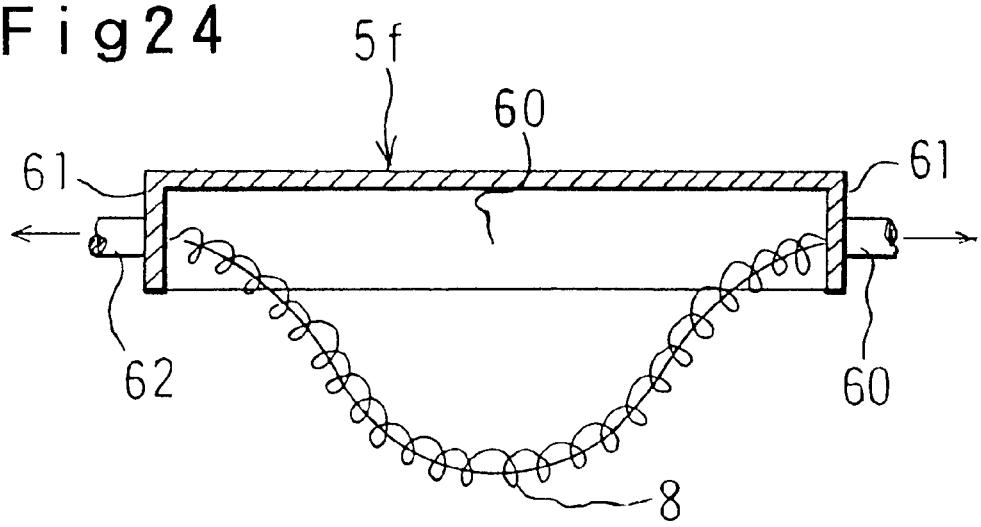
Figure 25:
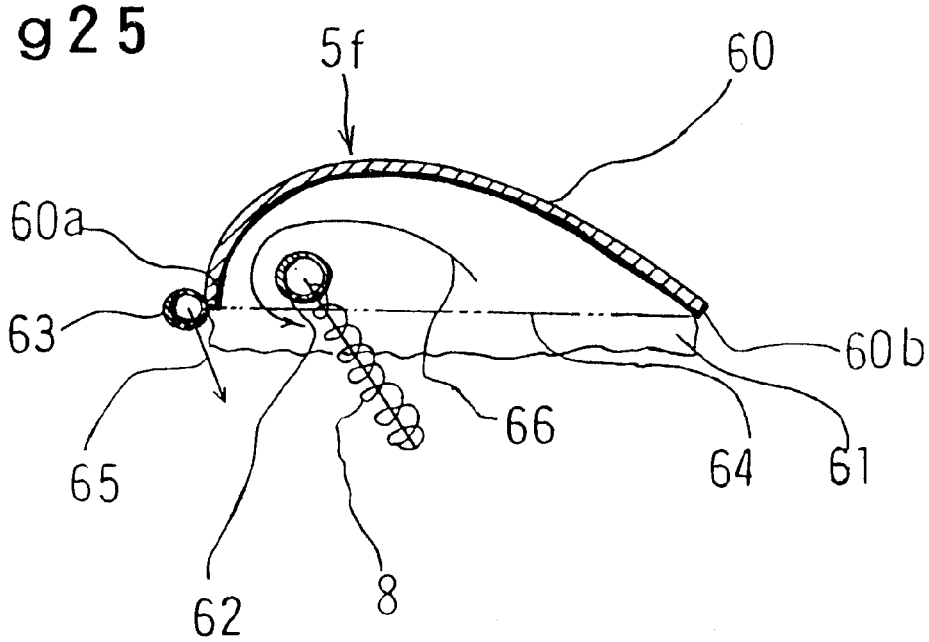

FIGS. 24 and 25 illustrate a tornado generator unit 5*f* according to a further embodiment of the present invention. The tornado generator unit 5*f* comprises a curved plate 60; shield plates 61 at both ends of the curved plate 60; a suction hole 62 formed through at least one of the shield plates 61; and an air blow-out pipe 63 at one end 60*a* of the curved plate 60. The air blown out from the air blow-out pipe 63 is directed between a plane 64 including both ends 60*a*, 60*b* of the curved plate 60 and a plane perpendicular to the plane 64. Air blown out from the air blow-out pipe 63 forms an air curtain 65, and simultaneously air is sucked from the suction hole 62. Consequently, a revolving air flow 66, guided by the curved plate 60, is formed between the air curtain 65 and the curved plate 60. The revolving air flow 66 directs to the suction hole 62 and generates artificial tornados 8 in the lateral direction. It is therefore possible to manufacture the furniture having air control function of the present invention by incorporating the tornado generator unit 5*f*, illustrated in FIGS. 24 and 25, in a furniture body, for example, the table body 4.

Figure 26:
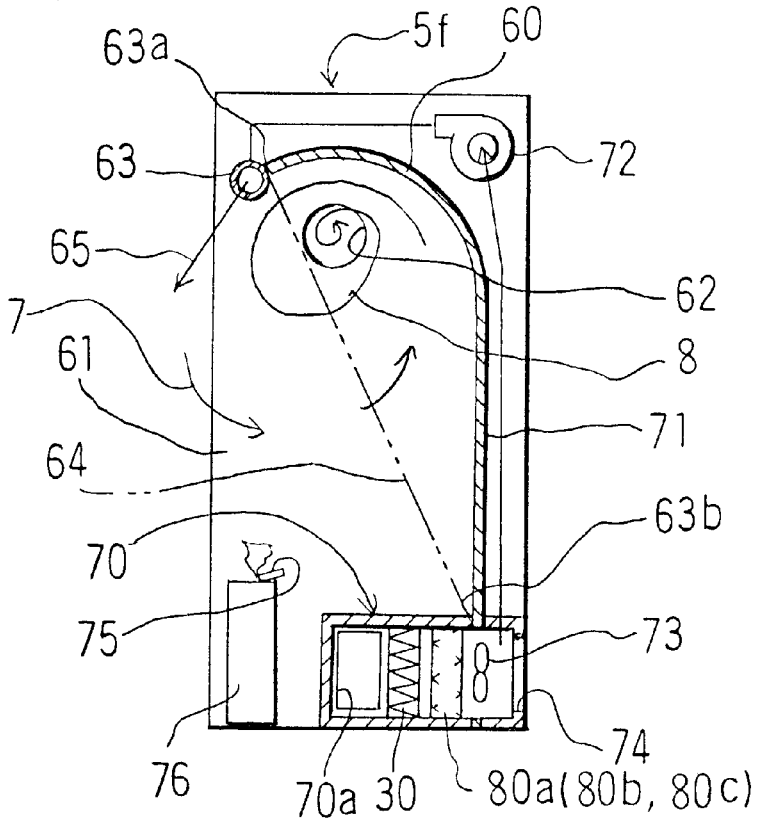

FIG. 26 illustrates-the tornado generator unit 5*f* incorporated in a chair, wherein a back board 71 of the chair including a curved plate 60 is positioned over a chair body 70, an air blow-out pipe 63 is mounted at the distal end of the curved plate 60. The air blow-out pipe 72 is connected to an air fan 72. Shield plates 61 are attached on both side of the back board 71, and a suction hole 62 is formed through each of the shield plates 61. The chair body 70 incorporates an air cleaner 30 and a ventilator 73, and a hole 70*a* of the chair body 70 communicates with the suction hole 62. In FIG. 26, reference numeral 74 designates an air exhaust port, 75 cigarette, and 76 ash.

When a man sitting on the chair body 70 smokes, the smoke is prevented by the air curtain 65 from leaking to the outside, immediately collected from a wide space by the artificial tornados 8 extending in the lateral direction, introduced into the chair body 70 through the suction hole 62 and the hole 70*a*, cleaned by the air cleaner 30, and exhausted by the ventilator 73 from the air exhaust port 74.

If an air conditioning apparatus 80*a* is arranged between the air cleaner 30 and the ventilator 73 and air sucked from the suction hole 62 is all blow out from the air blow-out pipe 63 to form the air curtain 65 without being exhausted to the outside from the air exhaust port 74, a space surrounded by the air curtain 65 can be effectively cooled or heated by the air conditioning apparatus 80*a*.

Alternatively, a minus ion generator 80*b* and/or a fragrance generatoramay 80*c* be provided in place of or in addition to the air conditioning apparatus 80*a*, in which case the space surrounded by the air curtain 65 can be filled with minus ions and/or fragrance, so that persons within the space can be bathed in the minus ions and/or the fragrance. It is known that a person bathing in the minus ions is given the same effect as he is when he is beside a waterfall. Thus, bathing in minus ions is good for health and can also calm the mind. The space filled with minus ions can also be utilized for meditation. The minus ion generator 80*b* may electrically generate minus ions. Alternatively, minus ions may be generated in the following process. First, fine water droplets are produced by injecting highly pressurized water from a nozzle against a wall surface. Then, air is supplied at a speed of 2–20 meters per second to the produced fine water droplets to remove relatively large water droplets by a cyclone to extract air only including extremely fine water droplets, thereby generating a large amount of minus ions.

Figure 27:
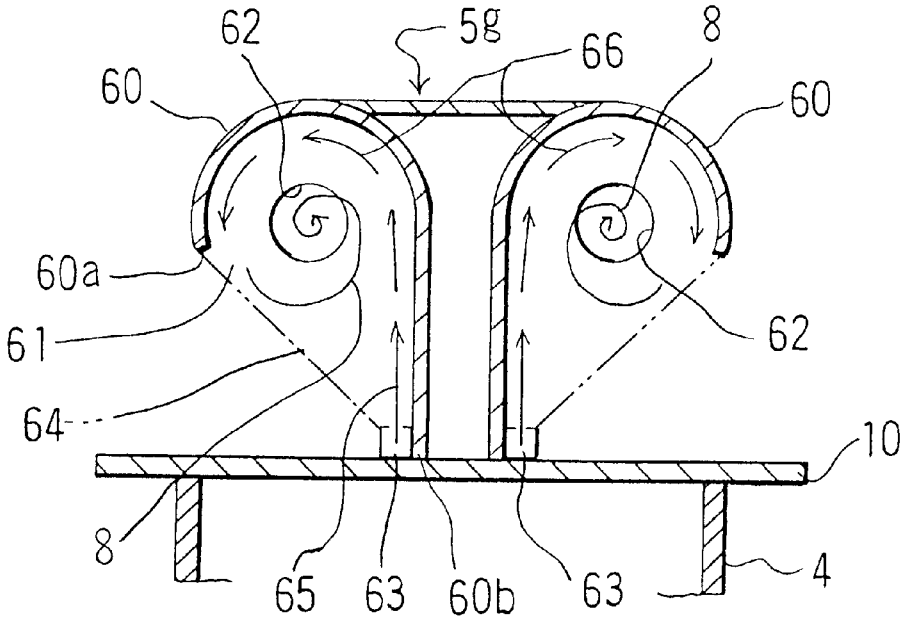

FIG. 27 illustrates a tornado generator unit 5*g* according to a further embodiment of the present invention. The tornado generator unit 5*g* defines the air blow-out direction of the air blow-out pipe 63 toward the curved plate 60 from the plane 64 including both the ends 60*a*, 60*b* of the curved plate 60 to generate linear artificial tornados 8 in the lateral direction. Thus, by incorporating the tornado generator unit 5*g* in a furniture body, for example, the table body 4, the furniture having air control functions of the present invention can be manufactured.

Figure 28:
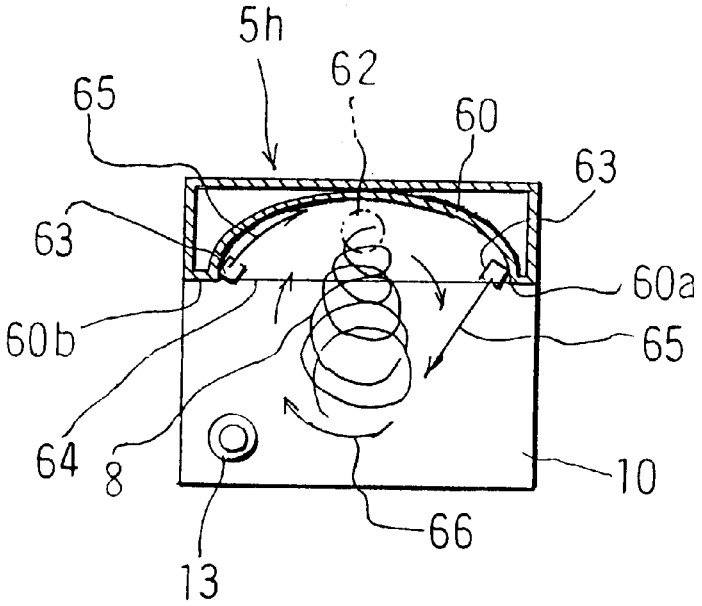

FIG. 28 illustrates a tornado generator unit 5*h* according to a further embodiment of the present invention. The tornado generator unit 5*h* includes a pair of air blow-out pipes 63 at both ends 60*a*, 60*b* of the curved plate 60. An air blow-out direction of one of the air blow-out pipe 63 is directed between a plane 64 including the two ends 60*a*, 60*b* of the curved plate 60 and a plane perpendicular to the plane 64, while an air blow-out direction of the other air blow-out pipe 63 is directed toward the curved plate 60 from the plane 64, thereby generating artificial tornados 8 in an oblique direction. Thus, by incorporating the tornado generator unit 5*h* in a furniture body, for example, the table body 4, the furniture having air control functions can be manufactured.

Figure 29:
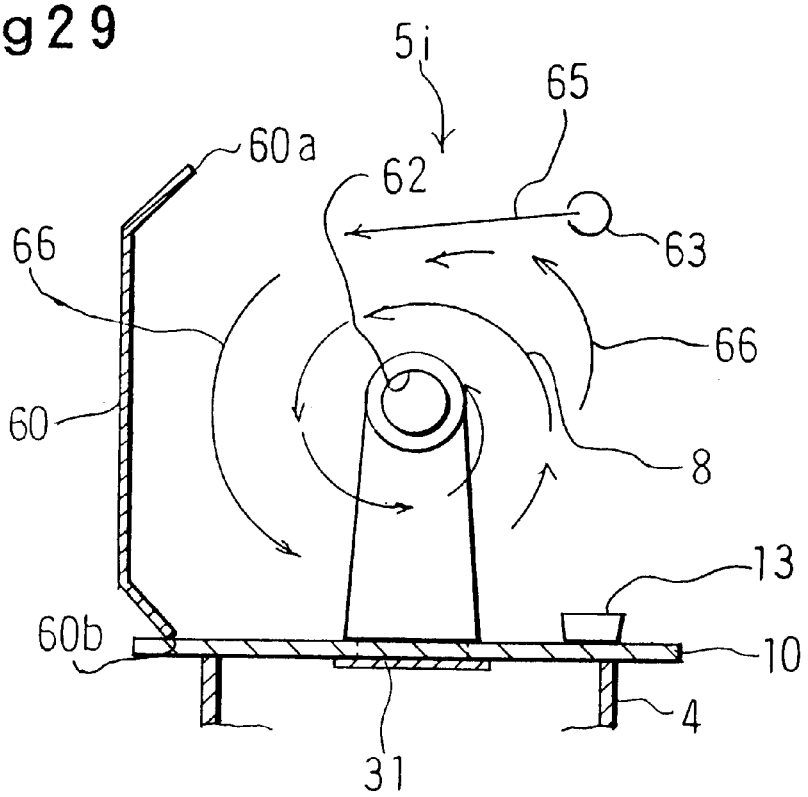

FIG. 29 illustrates a tornado generator unit 51 according to a further embodiment of the present invention. In the tornado generator unit 5*i*, the curved plate 60 is spaced apart from the air blow-out pipe 63 by a predetermined distance, with the air blow-out direction of the air blow-out pipe 63 directed toward an end of the curved plate 60, thus generating linear artificial tornados 8 in the lateral direction toward a pipe having a suction hole 62. Thus, by incorporating the tornado generator unit 5*i* in a furniture body, for example, the table body 4, the furniture having air control functions can be manufactured.

Figure 30:
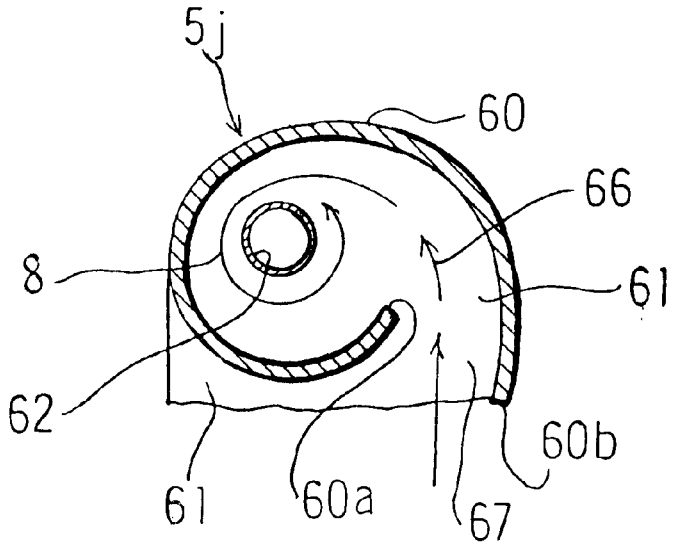

FIG. 30 illustrates a tornado generator unit 5*j* according to a further embodiment of the present invention. The tornado generator unit 5*j* differs from the foregoing embodiments in that the air blow-out pipe 63 is removed, shield plates 61 are mounted on both side surfaces of the curved plate 60 which is formed in such a manner that its plate surface gradually converges toward the center, a suction hole 62 is formed through each shield plate 61 at a position corresponding to the axial center of the curved plate 60, a suction port 67 is defined by one and the other ends 60*a*, 60*b* of the curved plate 60 and the shield plates 61, and the suction port 67 is located toward the other end 60*b* of the curved plate 60 from the central axis line of the suction hole 62. By sucking air from the suction hole 62, air sucked from the suction port 67 flows along the curved plate 60 to form a revolving air flow 66, thus generating artificial tornados 8 in the central axis direction toward the suction hole 62. Thus, by incorporating the tornado generator unit 5*j* in a furniture body, for example, the table body 4, the furniture having air control functions can be manufactured.

Figure 31:
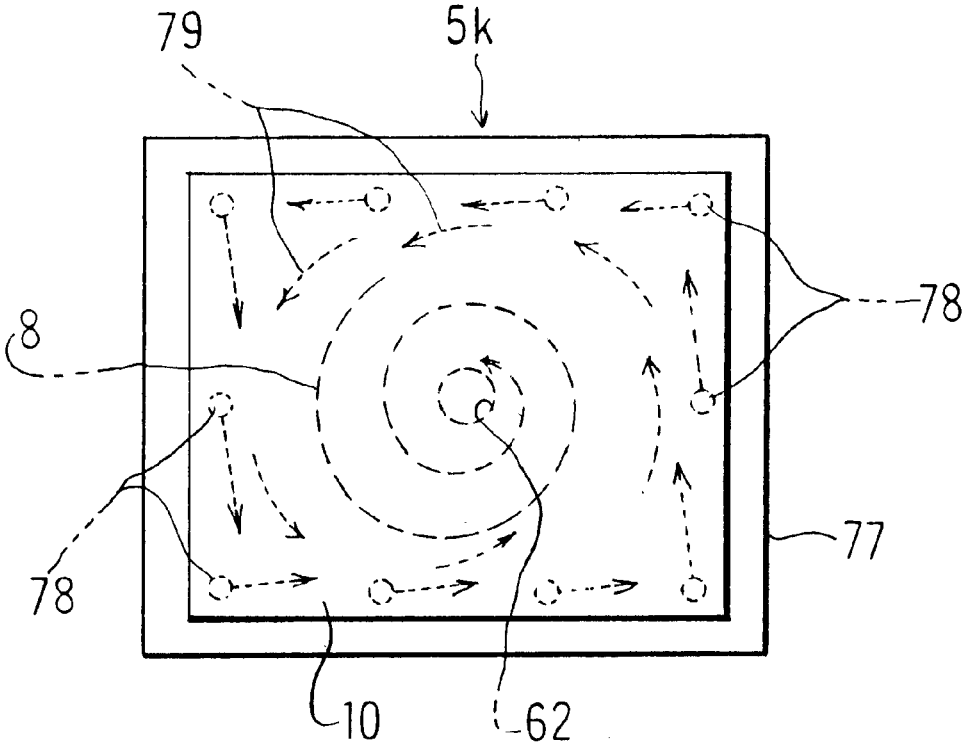
FIG. 31 is a top plane view illustrating another embodiment of the present invention.

FIG. 31 illustrates a tornado generator unit 5*k* according to a further embodiment of the present invention. The tornado generator unit 5*k* differs from the foregoing embodiments in that the air blow-out pipe 63 is removed, a plurality of air flow-out ports 78 are formed on a plane 77, on which the tornado generator unit 5*k* is installed, surrounding a top plate 10 opposite to the plate 77 at an angle relative to the installation plane, the plurality of air blow-out ports 78 are set to blow out air in the same rotating direction to form a revolving air flow 7, and a suction hole 62 is formed through the top plate 10 at a position within the range of the revolving air flow 79. By blowing down air from the air blow-out port 78 and sucking air from the suction hole 62, the revolving air flow 79 is formed to generate artificial tornados 8 toward the suction hole 62. Thus, by incorporating the tornado generator unit 5*k* in a furniture body, for example, the table body 4, the furniture having air control functions can be manufactured.

The foregoing description of the specific embodiments will so fully reveal the general nature of the invention that others can, by applying current knowledge, readily modify and/or adapt for various applications such specific embodiments without departing from the generic concept, and therefore such adaptations and modifications should and are intended to be comprehended within the meaning and range of equivalents of the disclosed embodiments. Accordingly, the invention is intended to embrace all such alternatives, modifications, equivalents and variations as fall within the spirit and broad scope of the appended claims.

What is claimed is:

1. A furniture having air control functions, comprising:

a) a furniture body having an air inlet opening, an air outlet opening, a bottom, and a side wall with a bottom;

b) an air fan disposed in said furniture body for sucking air through said inlet opening in said furniture body and for exhausting the air through said outlet opening in said furniture body; and c) tornado generating means comprising a cylinder having a window formed through a peripheral wall thereof and having in at least one end surface an intake port for receiving ambient air and an outlet port communicating with said air inlet opening in said furniture body, so that said air fan within said furniture body causes the air within said cylinder of said tornado generating means to create a tornado, said air being continuously sucked out of and exhausted through said outlet opening in said furniture body.

2. A furniture having air control functions according to claim 1, wherein said body is open at the top and further comprising:

air cleaning means arranged in said furniture body between the outlet opening and the tornado generating means;

a top plate placed on said furniture body; and said inlet opening being formed through said top plate, said tornado generating means being removably placed on said top plate overlaying said inlet opening.

3. The apparatus according to claim 1, wherein an air suction opening in said cylinder is formed adjacent said window.

4. The apparatus according to claim 3, wherein said outlet opening in said furniture body is positioned at said bottom of said furniture body; said inlet and outlet ports of said tornado generating means are openings positioned higher than said outlet opening in said furniture body to prevent entry of large particles into said furniture body; said furniture body further has at least one bypass exhaust outlet opening placed proximate said bottom of said side wall of said furniture body for exhausting a portion of the air such that the amount of the air exhausted from said outlet opening in said furniture body is reduced in order to prevent causing a chill to a user of said furniture at his feet; said tornado generating means further comprises two cylinders that are spaced from each other, so that said windows do not face each other; a top cover placed over said two cylinders such that a gap is formed between said two cylinders and said top cover said gap comprises said suction opening; side covers that cover said end surfaces of said two cylinders such that suction holes are covered in order to improve reception of the air from said suction opening; said air cleaning means further comprises a prefilter and an electrical precipitator for the air to pass through sequentially and further comprises deodorizing filters that cover said outlet opening and said bypass exhaust outlet opening; said electrical precipitator has a built-in program to turn off its power supply for a predetermined time period when its electrodes are short circuited, and if short circuiting occurs, generates an alarm a predetermined number of times within a predetermined time period.

5. A furniture having air control functions, comprising:

a) a furniture body having an air inlet opening, an air outlet opening, a bottom, a top, and a side wall with a bottom; said furniture body being open at said top of said furniture body;

b) an air fan disposed in said furniture body for sucking air through said inlet opening in said furniture body and for exhausting the air through said outlet opening in said furniture body;

c) tornado generating means comprising a cylinder having end surfaces, an intake port for receiving ambient air and an outlet port communicating with said air inlet opening in said furniture body, so that said air fan within said furniture body causes the air with said cylinder of said tornado generating means to create a tornado, being continuously sucked out of, and exhausted through, said outlet opening in said furniture body; said cylinder of said tornado generating means includes a window formed through a peripheral wall thereof; said intake port in said cylinder of said tornado generating means being formed through at least one of said end surfaces of said cylinder of said tornado generating means;

d) air cleaning means arranged is said furniture body between said outlet opening in said furniture body and said tornado generating means; and e) a top plate placed on said furniture body; said inlet opening in said furniture body being formed through said top plate; said tornado generating means being removably placed on said top plate overlying said inlet opening in said furniture body.

* * * * *